US009784273B2

(12) United States Patent
Tsuda

(10) Patent No.: US 9,784,273 B2
(45) Date of Patent: Oct. 10, 2017

(54) GAS COMPRESSOR HAVING BLOCK AND PRESSURE SUPPLY PARTS COMMUNICATING WITH BACKPRESSURE SPACE

(71) Applicant: CALSONIC KANSEI CORPORATION, Saitama-shi, Saitama (JP)

(72) Inventor: Masahiro Tsuda, Saitama (JP)

(73) Assignee: CALSONIC KANSEI CORPORATION, Saitama-Shi (JP)

( * ) Notice: Subject to any disclaimer, the term of this patent is extended or adjusted under 35 U.S.C. 154(b) by 0 days.

(21) Appl. No.: 15/110,519

(22) PCT Filed: Dec. 5, 2014

(86) PCT No.: PCT/JP2014/082229
§ 371 (c)(1),
(2) Date: Jul. 8, 2016

(87) PCT Pub. No.: WO2015/104930
PCT Pub. Date: Jul. 16, 2015

(65) Prior Publication Data

US 2016/0333877 A1 Nov. 17, 2016

(30) Foreign Application Priority Data

Jan. 9, 2014 (JP) ..... 2014-002173

(51) Int. Cl.
*F03C 4/00* (2006.01)
*F04C 2/00* (2006.01)
(Continued)

(52) U.S. Cl.
CPC ..... *F04C 18/344* (2013.01); *F01C 21/0863* (2013.01); *F04C 18/3442* (2013.01);
(Continued)

(58) Field of Classification Search
CPC .... F04C 18/344; F04C 18/3442; F04C 29/02; F04C 29/026; F04C 29/00; F04C 29/0064;
(Continued)

(56) References Cited

U.S. PATENT DOCUMENTS 4,455,129 A 6/1984 Sakitani et al.
4,810,177 A * 3/1989 Shibuya ..... F01C 21/0872 418/82
(Continued)

FOREIGN PATENT DOCUMENTS

CN 1492151 A 4/2004
JP S-58-014491 U1 1/1983
(Continued)

*Primary Examiner* — Theresa Trieu
(74) *Attorney, Agent, or Firm* — Foley & Lardner LLP

(57) ABSTRACT

A gas compressor includes a block part inside which a cylinder chamber is formed; a rotor rotatably housed in the cylinder chamber; and vanes provided on an outer circumferential portion of the rotor. The block part has a pressure supply part configured to supply pressure to backpressure spaces behind the vanes. This pressure supply part has an intermediate-pressure supply part which communicates with each backpressure space from an intake cycle to a compression cycle in the compression chamber, a first high-pressure supply part which communicates with the backpressure space from the compression cycle to a discharge cycle in the compression chamber, and a second high-pressure supply part which is formed between the intermediate-pressure supply part and the first high-pressure supply part independently of the first high-pressure supply part and which communicates with the backpressure space in a middle of the compression cycle in the compression chamber.

4 Claims, 7 Drawing Sheets

(51) Int. Cl.

| | |
|---|---|
| ***F04C 15/00*** | (2006.01) |
| ***F04C 29/00*** | (2006.01) |
| ***F04C 18/344*** | (2006.01) |
| ***F01C 21/08*** | (2006.01) |
| ***F04C 29/02*** | (2006.01) |

(52) U.S. Cl.
CPC ..... *F04C 29/00* (2013.01); *F04C 29/0064* (2013.01); *F04C 29/026* (2013.01); *F04C 2210/26* (2013.01); *F04C 2240/30* (2013.01); *F04C 2240/40* (2013.01); *F04C 2240/805* (2013.01); *F04C 2240/808* (2013.01)

(58) Field of Classification Search
CPC ..... F04C 2/344; F04C 2240/809; F04C 2240/30; F04C 2240/40; F04C 2240/805; F04C 2240/808; F01C 21/0809; F01C 21/0863; F01C 21/0872
USPC ..... 418/76, 81–82, 133, 259, 266–268, 270, 418/DIG. 1
See application file for complete search history.

(56) References Cited

U.S. PATENT DOCUMENTS

| | | | | |
|---|---|---|---|---|
| 5,096,387 | A | 3/1992 | Iio | |
| 7,150,610 | B2 * | 12/2006 | Takahashi | F01C 21/0872 418/82 |
| 2002/0119054 | A1 * | 8/2002 | Morita | F01C 21/0863 418/268 |
| 2004/0136841 | A1 | 7/2004 | Takahashi et al. | |
| 2014/0369878 | A1 | 12/2014 | Shimaguchi et al. | |

FOREIGN PATENT DOCUMENTS

| | | | | |
|---|---|---|---|---|
| JP | H-01-141391 | U1 | 9/1989 | |
| JP | 02-248682 | A | 10/1990 | |
| JP | 2004-092494 | A | 3/2004 | |
| JP | 2013-194549 | A | 9/2013 | |
| JP | 2014013035 | A * | 1/2014 | F04C 18/3441 |

* cited by examiner

PRIOR ART COMPRESSION BLOCK

PRIOR ART COMPRESSION BLOCK

GAS COMPRESSOR HAVING BLOCK AND PRESSURE SUPPLY PARTS COMMUNICATING WITH BACKPRESSURE SPACE

TECHNICAL FIELD

The present invention relates to a vane rotary type gas compressor.

BACKGROUND ART

Various types of gas compressors have been proposed heretofore (e.g., Patent Literature 1).

FIG. 6 shows a compression block used in a conventional gas compressor.

This compression block (block part) has a tubular cylinder block 100 and paired side blocks 101 placed on the left and right ends of the cylinder block 100 to sandwich the cylinder block 100. The cylinder block 100 and the paired side blocks 101 define a cylinder chamber 104 within the compression block. The cylinder block 100 is provided with an intake port 110 and two discharge ports 108.

A rotor 102 is rotatably housed in the cylinder chamber 104. Multiple vane grooves 106 are formed in an outer circumferential surface of the rotor 102 at intervals in a circumferential direction (rotary direction W) of the rotor 102. Vanes 103 (103*a*, 103*b*, 103*c*) are placed in the respective vane grooves 106 such that the vanes 103 can emerge from the outer circumferential surface of the rotor 102. In the vane grooves 106, backpressure spaces 107 (107A, 107B, 107C) are formed behind the vanes 103. Each of these backpressure spaces 107 opens onto both left and right end surfaces of the rotor 102.

An intermediate-pressure supply groove (intermediate-pressure supply part) 113 and a high-pressure supply groove (high-pressure supply part) 114 are formed in an end surface of each of the side blocks 101 on the cylinder chamber 104 side (inner end surface), at positions on a rotational trajectory of the backpressure spaces 107. The intermediate-pressure supply groove 113 is supplied with fluid (e.g., oil) at an intermediate pressure which is higher than the pressure of refrigerant gas taken into compression chambers 105 and lower than the pressure of refrigerant gas discharged from the compression chambers 105. The high-pressure supply groove 114 is supplied with fluid at a high pressure which is equivalent to the pressure of refrigerant gas discharged from the compression chambers 105.

In the cylinder chamber 104, the compression chamber 105 (105*a*, 105*b*, 105*c*) is defined by an inner circumferential surface of the cylinder chamber 104, the outer circumferential surface of the rotor 102, and corresponding two vanes 103 adjacent in the circumferential direction of the rotor 102. While the rotor 102 rotates, an intake cycle, a compression cycle, and a discharge cycle are repeatedly carried out in each compression chamber 105.

In the intake cycle in each compression chamber 105, the volume of the compression chamber 105 increases gradually as the rotor 102 rotates, and the refrigerant gas is taken into the compression chamber 105 through the intake port 110.

In the compression cycle in the compression chamber 105, the volume of the compression chamber 105 decreases gradually as the rotor 102 rotates, and the refrigerant gas in the compression chamber 105 is compressed.

In the discharge cycle in the compression chamber 105, the volume of the compression chamber 105 decreases gradually as the rotor 102 rotates, and when the pressure of the refrigerant gas (refrigerant pressure) inside the compression chamber 105 reaches a predetermined pressure, an on-off valve 109 opens to discharge the refrigerant gas from the compression chamber 105 through the discharge port 108.

In such a series of cycles, the vanes 103*a*, 103*b*, 103*c* receive the pressure of the refrigerant gas in the corresponding compression chambers 105*a*, 105*b*, 105*c*, the pressure acting in directions in which the vanes 103*a*, 103*b*, 103*c* retreat into their corresponding vane grooves 106 (referred to as "retreating directions" below). Meanwhile, the pressure of the fluid in the backpressure spaces 107 (backpressure) acting on the vanes 103*a*, 103*b*, 103*c* presses the tips of the vanes 103*a*, 103*b*, 103*c* against the inner circumferential surface of the cylinder chamber 104. This backpressure enables the vanes 103 to restrict flow of the refrigerant gas between the compression chambers 105 adjacent in the circumferential direction of the rotor 102, ensuring compression of the refrigerant gas in each compression chamber 105*a*, 105*b*, 105*c*.

The pressure of the refrigerant gas in each compression chamber 105 acting on the vane 103 in the retreating direction is relatively low in the intake cycle and in the early compression cycle. Thus, in areas corresponding to these cycles, the backpressure space 107 is caused to communicate with the intermediate-pressure supply groove 113 so that intermediate pressure of the fluid in the intermediate-pressure supply groove 113 may act on the vane 103 as backpressure. On the other hand, the pressure of the refrigerant gas in the compression chamber 105 acting on the vane 103 in the retreating direction is relatively high in the late compression cycle and the discharge cycle. Thus, in the area corresponding to these cycles, the backpressure space 107 is caused to communicate with the high-pressure supply groove 114 so that high pressure of the fluid in the high-pressure supply groove 114 may act on the vane 103 as backpressure. The backpressure acting on the vanes 103 is thus changed according to the pressure of the refrigerant gas in the compression chambers 105 acting on the vanes 103 in their retreating directions, so that the vanes 103 slide on the inner circumferential surface of the cylinder chamber 104 with a minimum resistance to save fuel consumption.

CITATION LIST

Patent Literature

Patent Literature 1: Japanese Patent Application Publication No. 2013-194549

SUMMARY OF INVENTION

In the conventional gas compressor described above, in the process of shifting the state where the backpressure space 107 communicates with the intermediate-pressure supply groove 113 to the state where the backpressure space 107 communicates with the high-pressure supply groove 114, the fluid in the backpressure space 107 which has just finished communicating with the intermediate-pressure supply groove 113 is at an intermediate pressure. Thus, even when this backpressure space 107 communicates with the high-pressure supply groove 114, the fluid in the backpressure space 107 does not reach a high pressure immediately, as shown by reference sign P1 in FIG. 7, because the pressure of the fluid in the backpressure space 107 is still affected by the intermediate pressure. In other words, in the area where the backpressure space 107 communicates with the high-pressure supply groove 114, the tip of the vane 103 does not protrude stably all the way to the inner circumferential surface of the cylinder chamber 104 unless the fluid in the backpressure space 107 becomes a high pressure. When the tip of the vane 103 does not protrude stably, the vane 103 repeats departing from and colliding with the inner circumferential surface of the cylinder chamber 104. This may cause noise (chattering).

In the conventional gas compressor described above, two backpressure spaces 107 adjacent in the circumferential direction of the rotor 102 communicate with the same high-pressure supply groove 114 at the same time. If, for example, the rotor 102 rotates further in the rotary direction W when the rotationally-upstream backpressure space 107A is communicating with the high-pressure supply groove 114, the rotationally-downstream backpressure space 107B also communicates with the high-pressure supply groove 114. Consequently, the pressure of the fluid in the rotationally-upstream backpressure space 107A drops temporarily, as shown by reference sign P2 in FIG. 7. Chattering may occur in this event. The rotationally-upstream vane 103*a* is particularly likely to cause chattering because the pressure acting on the rotationally-upstream vane 103*a* in the retreating direction is higher than that acting on the rotationally-downstream vane 103*b* in the retreating direction.

It is therefore an object of the present invention to provide a gas compressor capable of reducing or eliminating chattering by preventing drop in the pressure in the backpressure space for the vane.

A gas compressor according to the present invention includes a block part inside which a cylinder chamber is formed, a rotor rotatably housed in the cylinder chamber, and a plurality of vanes which are provided on an outer circumferential portion of the rotor at an interval in a circumferential direction of the rotor, the vanes being capable of emerging from the outer circumferential portion. An inner circumferential surface of the cylinder chamber, an outer circumferential surface of the rotor, and each two of the vanes adjacent in the circumferential direction of the rotor define a compression chamber inside the cylinder chamber. The block part has a pressure supply part configured to supply pressure to backpressure spaces formed behind the respective vanes. The pressure supply part has an intermediate-pressure supply part which communicates with each backpressure space from an intake cycle to a compression cycle in the compression chamber, a first high-pressure supply part which communicates with the backpressure space from the compression cycle to a discharge cycle in the compression chamber, and a second high-pressure supply part which is formed between the intermediate-pressure supply part and the first high-pressure supply part independently of the first high-pressure supply part and which communicates with the backpressure space in a middle of the compression cycle in the compression chamber.

The first high-pressure supply part may be formed over an area where the first high-pressure supply part communicates simultaneously with two of the backpressure spaces adjacent in the circumferential direction of the rotor.

The block part has a tubular cylinder block and paired side blocks placed on both sides of the cylinder block, and the intermediate-pressure supply part, the first high-pressure supply part, and the second high-pressure supply part may be formed in an inner end surface of at least one of the paired side blocks.

DESCRIPTION OF EMBODIMENTS

An embodiment of the present invention will be described in detail below with reference to FIGS. 1 to 5.

A gas compressor 1 according to the present embodiment is a vane rotary type gas compressor, and is used as a compressor in, for example, an air-conditioning system.

Figure 1:
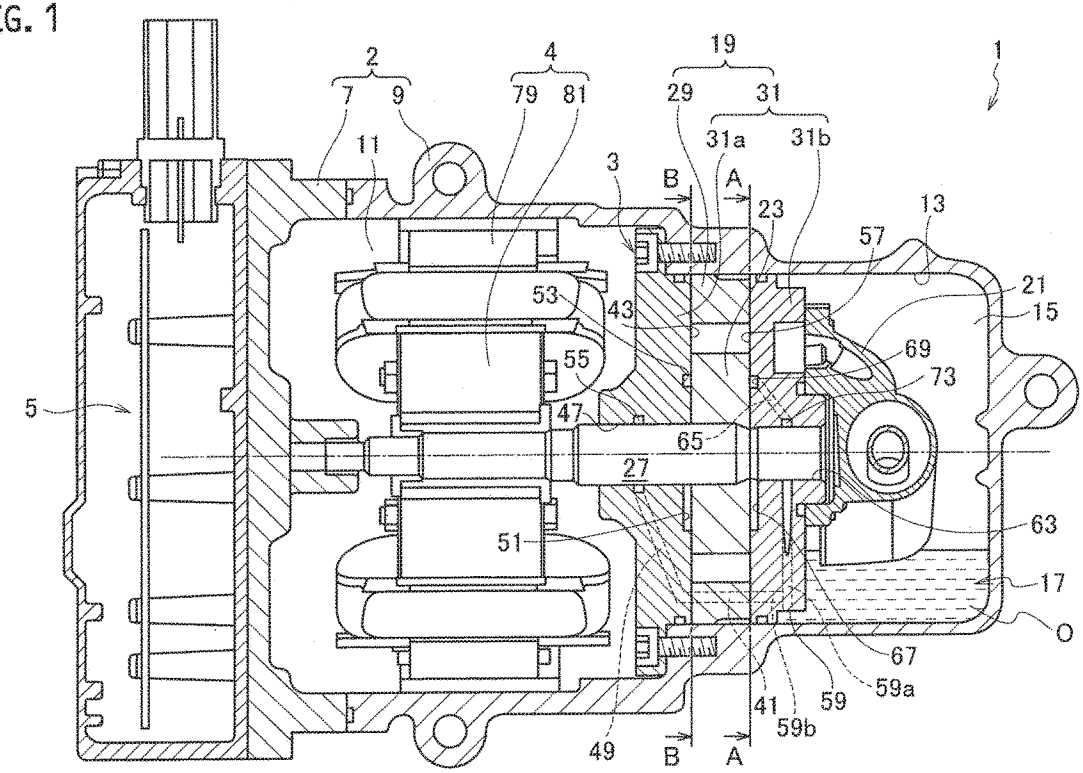
FIG. 1 is a longitudinal sectional view of a gas compressor according to an embodiment of the present invention.

As shown in FIG. 1, the gas compressor 1 according to the present embodiment includes a tubular (cylindrical in the present embodiment) housing 2, a compression part 3 housed in the housing 2, a motor part 4 configured to transmit its driving power to the compression part 3, and an inverter part 5 configured to control the driving of the motor part 4. The inverter part 5 is fixed to the housing 2.

The housing 2 consists mainly of a front head 7 in which an intake port (not shown) is formed and a rear case 9 having a closed bottom and an opening part which is closed by the front head 7.

The compression part 3 is fixed to the inner wall surface (inner circumferential surface) 13 of the rear case 9. The housing 2 defines an intake chamber 11 on one side of the compression part 3 and a discharge chamber 15 on the other side of the compression part 3. A discharge port (not shown) through which the discharge chamber 15 communicates with a refrigeration cycle is formed in an outer circumferential part of the rear case 9. An oil sump 17 which collects oil O for lubricating the compression part 3 is formed in the rear case 9, in a lower part of the discharge chamber 15.

The compression part 3 includes: a compression block (block part) 19 having a cylinder chamber 32 formed therein, an oil separator 21 fixed to the compression block 19, a rotor 23 rotatably housed in the cylinder chamber 32, vanes 25 (25A, 25B, 25C) fitted in corresponding vane grooves 75 of the rotor 23 such that the vanes 25 can emerge from the vane grooves 75, and a drive shaft 27 fixed to the rotor 23 to transmit the driving power to the rotor 23.

The compression block 19 consists mainly of a tubular (cylindrical in the present embodiment) cylinder block 29 and paired side blocks 31 (31*a*, 31*b*) placed on the left and right sides of the cylinder block 29 to sandwich the cylinder block 29.

Figure 3:
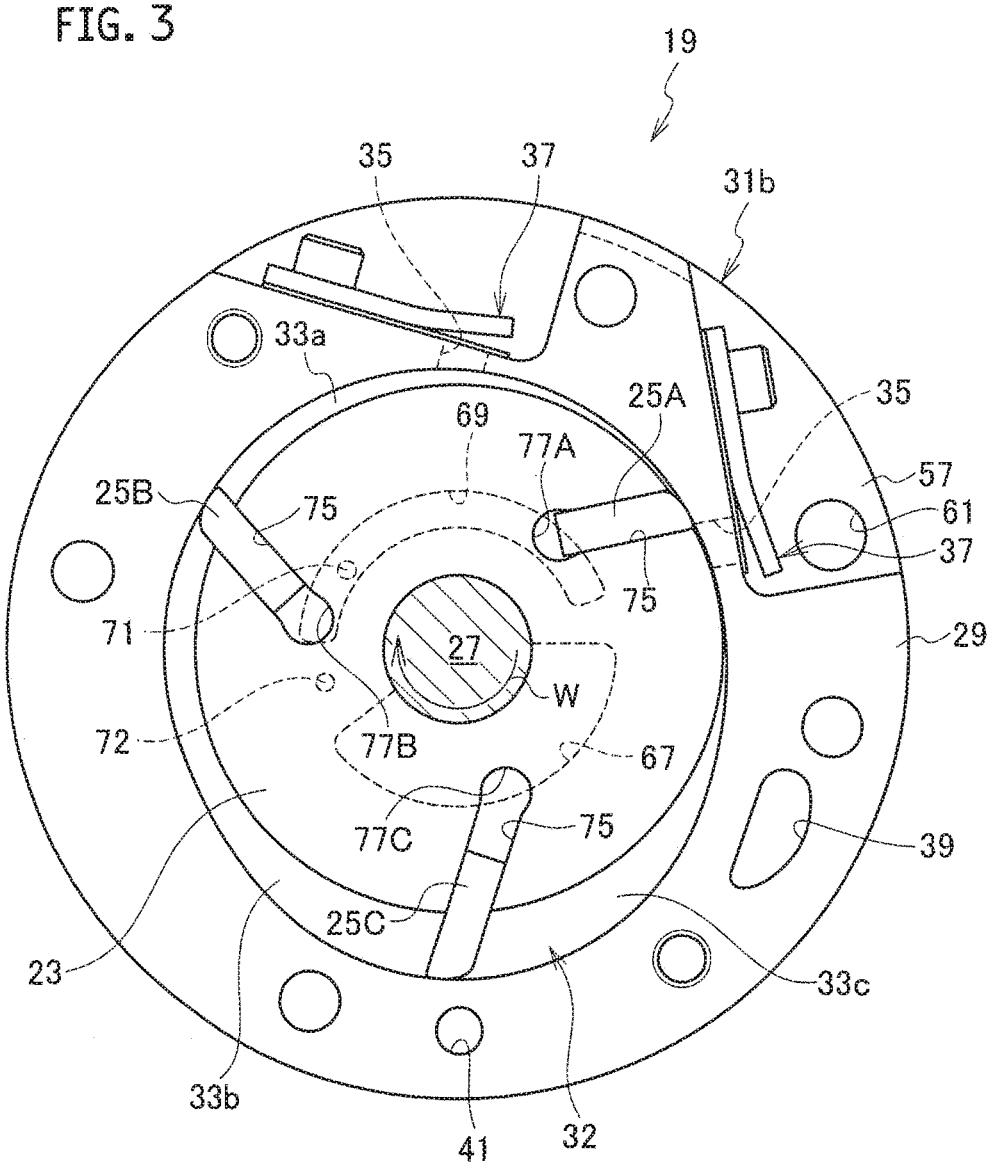
FIG. 3 is a view taken along line B-B in FIG. 1 and seen in the direction of the arrows.

As shown in FIG. 3, the cylinder block 29 has a bore of a distorted oval shape. The cylinder chamber 32 is defined in this bore of the cylinder block 29 by the paired side blocks 31 sandwiching the cylinder block 29. The vanes 25 partition the cylinder chamber 32 to define compression chambers 33 (33*a*, 33*b*, 33*c*) in the cylinder chamber 32. More specifically, each compression chamber 33 in the cylinder chamber 32 is defined by an inner circumferential surface of the cylinder chamber 32 (the above-described bore of the cylinder block 29), an outer circumferential surface of the rotor 23, and two vanes 25 adjacent in a circumferential direction of the rotor 23.

The cylinder block 29 includes an intake port 39 for taking refrigerant gas (or any gas) into the compression chambers 33, a discharge port 35 for discharging refrigerant gas compressed in the compression chambers 33, an on-off valve 37 for opening and closing the discharge port 35, and a cylinder oil supply channel 41 through which the front oil supply channel 49 of the side block 31*a* and a secondary rear oil supply channel 59*b* of the side block 31*b* communicate with each other.

As shown in FIG. 1, the paired side blocks 31 include the front side block 31*a* fixed to a front end portion (the left end portion in FIG. 1) of the cylinder block 29 and the rear side block 31*b* fixed to a rear end portion (the right end portion in FIG. 1) of the cylinder block 29. The oil separator 21 configured to separate oil from the refrigerant gas discharged from the compression chambers 33 is fixed to the rear side block 31*b*.

The front side block 31*a* includes an end surface (inner end surface) 43 which faces the cylinder block 29 and the cylinder chamber 32, an intake hole (not shown) which communicates with the intake port 39 of the cylinder block 29 to take in refrigerant gas from the intake chamber 11, a front bearing 47 which supports the drive shaft 27 while allowing the drive shaft 27 to rotate, and the front oil supply channel 49 which communicates with the cylinder oil supply channel 41.

A pressure supply part is formed in the inner end surface 43 of the front side block 31*a* to supply pressure to backpressure spaces 77 formed behind the vanes 25. This pressure supply part includes an intermediate-pressure supply groove (intermediate-pressure supply part) 51 and a high-pressure supply groove (first high-pressure supply part) 53. The intermediate-pressure supply groove 51 supplies the backpressure spaces 77 with fluid (oil in the present embodiment) at a pressure which is higher than that of the refrigerant gas taken into the compression chambers 33 and lower than that of the refrigerant gas discharged from the compression chambers 33. The high-pressure supply groove 53 supplies the backpressure spaces 77 with oil at a high pressure which is equivalent to that of refrigerant gas discharged from the compression chambers 33. The intermediate-pressure supply groove 51 is an arc-shaped groove (chamfered groove) extending in the circumferential direction of the rotor 23, and is formed at a position facing an intermediate-pressure supply groove 67 of the rear side block 31*b* in an axial direction of the drive shaft 27. The high-pressure supply groove 53 is an arc-shaped groove (chamfered groove) extending in the circumferential direction of the rotor 23, and is formed at a position facing a high-pressure supply groove 69 of the rear side block 31*b* in the axial direction of the drive shaft 27.

A front annular groove 55 in a ring shape is formed in the front bearing 47. The front annular groove 55 communicates with one end of the front oil supply channel 49, the other end of which communicates with the cylinder oil supply channel 41.

The rear side block 31*b* includes an end surface (inner end surface) 57 which faces the cylinder block 29 and the cylinder chamber 32, a discharge hole 61 for discharging refrigerant gas compressed in the compression chambers 33, an oil supply hole 59 for taking in the oil O collected in the oil sump 17 formed in the lower part of the discharge chamber 15, a rear bearing 63 configured to support the drive shaft 27 while allowing the drive shaft 27 to rotate, and the secondary rear oil supply channel 59*b* which communicates with the cylinder oil supply channel 41.

A pressure supply part configured to supply pressure to the backpressure spaces 77 behind the vanes 25 is formed in the inner end surface 57 of the rear side block 31*b*. The pressure supply part includes the intermediate-pressure supply groove (intermediate-pressure supply part) 67 configured to supply oil at the above-described intermediate pressure to the backpressure spaces 77, the high-pressure supply groove (high-pressure supply part) 69 configured to supply oil at the above-described high pressure to the backpressure spaces 77, and a high-pressure supply hole (second high-pressure supply part) 72 formed independently of the intermediate-pressure supply groove 67 and the high-pressure supply groove 69 and configured to supply oil at the high pressure to the backpressure spaces 77. The intermediate-pressure supply groove 67 is an arc-shaped groove (chamfered groove) extending in the circumferential direction of the rotor 23, and is formed at a position facing the intermediate-pressure supply groove 51 of the front side block 31*a* in the axial direction of the drive shaft 27. The high-pressure supply groove 69 is an arc-shaped groove (chamfered groove) extending in the circumferential direction of the rotor 23, and is formed at a position facing the high-pressure supply groove 53 of the front side block 31*a* in the axial direction of the drive shaft 27.

The high-pressure supply hole may be provided also to the front side block 31*a*, or the intermediate-pressure supply groove, the high-pressure supply groove, and the high-pressure supply hole may be provided only to one of the inner end surfaces 43 and 57 of the paired side blocks 31.

Figure 2:
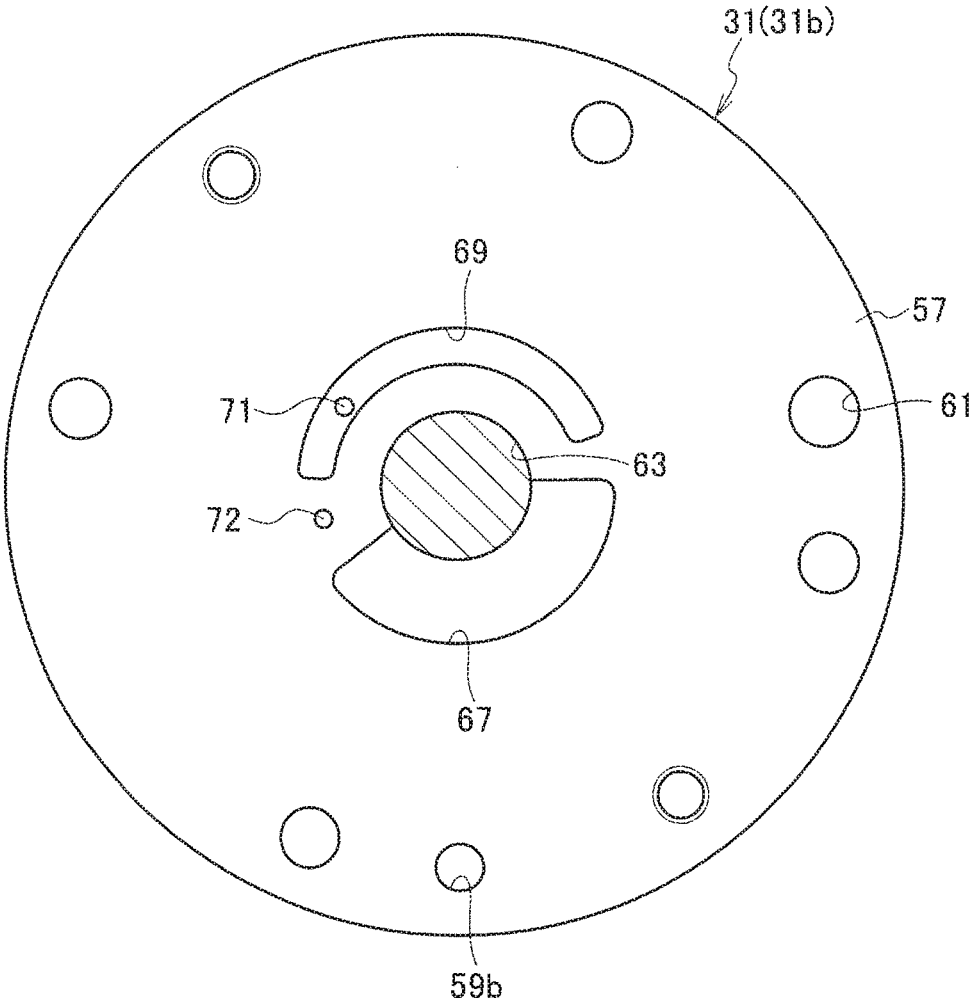
FIG. 2 is a view taken along line A-A in FIG. 1 and seen in the direction of the arrows.

As shown in FIG. 2, a high-pressure supply channel 71, at one end, opens into the high-pressure supply groove 69, and at the other end, communicates with a rear communication channel 65.

The high-pressure supply hole 72, at one end, communicates with a rear annular groove 73, and at the other end, opens onto the inner end surface 57 of the rear side block 31*b*, at an area between the intermediate-pressure supply groove 67 and the high-pressure supply groove 69. In other words, the high-pressure supply hole 72 is formed at a position between the intermediate-pressure supply groove 67 and the high-pressure supply groove 69 in the circumferential direction of the rotor 23. At this position, the high-pressure supply hole 72 communicates with the backpressure space 77 during the compression cycle in the compression chamber 33.

As described earlier, the high-pressure supply hole 72 is formed in the inner end surface 57 of the rear side block 31*b*, independently of the intermediate-pressure supply groove 67 and the high-pressure supply groove 69. In other words, the high-pressure supply hole 72 is formed in the inner end surface 57 at a distance from each of the intermediate-pressure supply groove 67 and the high-pressure supply groove 69. A distance h1 between the intermediate-pressure supply groove 67 and the high-pressure supply hole 72 in the circumferential direction of the rotor 23 is larger (wider) than a width h2 of each backpressure space 77. A distance h3 between the high-pressure supply hole 72 and the high-pressure supply groove 69 in the circumferential direction of the rotor 23 may be either larger (wider) or smaller (narrower) than the width of the backpressure space 77.

The rear annular groove 73 in the ring shape is formed in the rear bearing 63, and communicates with one end of a primary rear oil supply channel 59*a*, the other end of which communicates with the oil supply hole 59. The primary rear oil supply channel 59*a* communicates with one end of the secondary rear oil supply channel 59*b* which branches off from the primary rear oil supply channel 59*a*. The other end of the secondary rear oil supply channel 59*b* communicates with the cylinder oil supply channel 41. The rear annular groove 73 communicates with one end of the rear communication channel 65, the other end of which communicates with the high-pressure supply channel 71.

Figure 4:
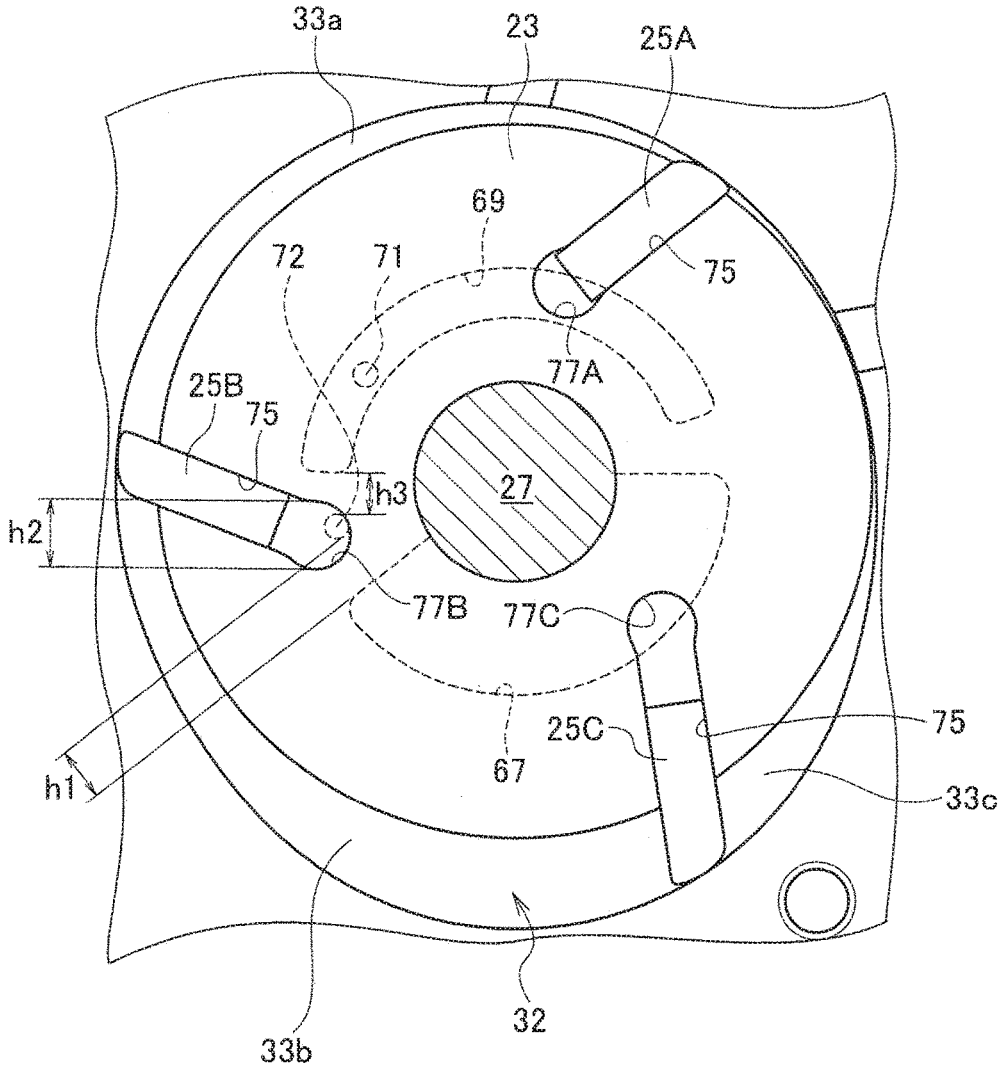
FIG. 4 is an enlarged view of a main portion of a compression block in FIG. 3.

As shown in FIGS. 3 and 4, the rotor 23 is placed in such a manner that a portion of the rotor 23 touches the inner wall surface (inner circumferential surface) of the cylinder chamber 32 and that the rotational center of the rotor 23 does not coincide with the center of the cylinder chamber 32. The rotor 23 has the vane grooves 75 and the backpressure spaces 77 (77A, 77B, 77C) formed in the vane grooves 75 and behind the vanes 25. The vane grooves 75 are formed in an outer circumferential portion of the rotor 23 at intervals in the circumferential direction of the rotor 23.

These backpressure spaces 77 open onto the left and right end surfaces of the rotor 23. As the rotor 23 rotates, each backpressure space 77 communicates with the intermediate-pressure supply grooves 51, 67 during the intake cycle and the early compression cycle in the compression chamber 33, communicates with the high-pressure supply hole 72 during the middle compression cycle in the compression chamber 33, and communicates with the high-pressure supply grooves 53, 69 during the late compression cycle and the discharge cycle in the compression chamber 33.

The drive shaft 27 is fixed to the rotor 23 at one end thereof and is rotatably supported by the front bearing 47 of the side block 31*a* and the rear bearing 63 of the side block 31*b*. The other end of the drive shaft 27 is fixed to a motor rotor 81 of the motor part 4.

The motor part 4 includes a stator 79 fixed to the inner wall surface 13 of the rear case 9 and the motor rotor 81 placed rotatably inside the stator 79 and configured to be rotated by a magnetic force. The motor part 4 transmits its driving power to the compression part 3 by the rotation of the motor rotor 81.

Next, operation of the gas compressor 1 according to the present embodiment is described.

First, the inverter part 5 performs control so that current flows through a coil wound on the stator 79 of the motor part 4. A magnetic force is generated by the current flowing through the coil, rotating the motor rotor 81 placed inside the stator 79.

The rotation of the motor rotor 81 rotates the drive shaft 27 whose one end is fixed to the motor rotor 81, and in turn rotates the rotor 23 fixed to the other end of the drive shaft 27.

As the rotor 23 rotates, refrigerant gas flows into the intake chamber 11. The refrigerant gas flows from the intake chamber 11 into each compression chamber 33, through the intake hole (not shown) of the front side block 31*a* and the intake port 39 of the cylinder block 29 (intake cycle). The refrigerant gas taken into the compression chamber 33 is compressed as the rotor 23 rotates (compression cycle).

The refrigerant gas compressed in the compression chamber 33 pushes the on-off valve 37 open and is discharged from the compression chamber 33 through the discharge port 35 (discharge cycle), and is then discharged to the discharge chamber 15 through the discharge hole 61 and the oil separator 21 which separates oil from the refrigerant gas. The resultant refrigerant gas is then discharged to the refrigeration cycle (not shown) through the discharge port (not shown), and the oil is collected in the oil sump 17 formed in the lower part of the discharge chamber 15.

The oil O collected in the oil sump 17 in the lower part of the discharge chamber 15 enters the primary rear oil supply channel 59*a* from the oil supply hole 59, and is supplied to the rear annular groove 73.

The high-pressure oil supplied to the rear annular groove 73 is then supplied to the intermediate-pressure supply groove 67 by passing through a space between the drive shaft 27 and the rear bearing 63. By the time the oil is supplied to the intermediate-pressure supply groove 67, the oil is at an intermediate pressure by being squeezed between the drive shaft 27 and the rear bearing 63, the intermediate pressure being higher than that of the refrigerant gas taken into the compression chamber 33 (intake pressure) and lower than that of the refrigerant gas discharged from the compression chamber 33 (discharge pressure).

The intermediate-pressure oil supplied to the intermediate-pressure supply groove 67 of the rear side block 31*b* is, as shown in FIG. 3, supplied to the backpressure space 77 in the intake cycle and the early compression cycle in the compression chamber 33, so that intermediate pressure is supplied to the back of the vane 25 to cause the vane 25 to protrude from the vane groove 75.

The high-pressure oil supplied to the rear annular groove 73 is also supplied to the high-pressure supply groove 69 by passing through the rear communication channel 65 and the high-pressure supply channel 71.

The high-pressure oil supplied to the high-pressure supply groove 69 of the rear side block 31*b* is, as shown in FIG. 3, supplied to the backpressure space 77 in the late compression cycle and the discharge cycle in the compression chamber 33, so that high pressure is supplied to the back of the vane 25 to cause the vane 25 to protrude from the vane groove 75. The high-pressure supply groove 69 of the rear side block 31*b* communicates with the high-pressure supply groove 53 of the front side block 31*a* through the backpressure spaces 77, so that the backpressure spaces 77 are supplied with the high-pressure oil from the high-pressure supply groove 53, as well.

The high-pressure oil supplied to the rear annular groove 73 is also supplied to the high-pressure supply hole 72 opening onto the inner end surface 57 of the rear side block 31*b*.

The high-pressure oil supplied to the high-pressure supply hole 72 of the rear side block 31*b* is, as shown in FIG. 3, supplied to the backpressure space 77 in the middle compression cycle in the compression chamber 33, so that high pressure is supplied to the back of the vane 25 before the backpressure space 77 communicates with the high-pressure supply groove 69.

The oil O collected in the oil sump 17 formed in the lower part of the discharge chamber 15 enters the primary rear oil supply channel 59*a* from the oil supply hole 59 of the rear side block 31*b*, passes through the secondary rear oil supply channel 59*b*, the cylinder oil supply channel 41, and the front oil supply channel 49, and is supplied to the front annular groove 55.

The high-pressure oil supplied to the front annular groove 55 passes through a space between the drive shaft 27 and the front bearing 47, and is supplied to the intermediate-pressure supply groove 51. By the time the oil is supplied to the intermediate-pressure supply groove 51, the oil is at an intermediate pressure by being squeezed between the drive shaft 27 and the front bearing 47.

The intermediate-pressure oil supplied to the intermediate-pressure supply groove 51 of the front side block 31*a* is, as shown in FIG. 3, supplied to the backpressure space 77 in the intake cycle and the early compression cycle in the compression chamber 33, so that intermediate pressure is supplied to the back of the vane 25 to cause the vane 25 to protrude from the vane groove 75.

According to the present invention, the high-pressure supply hole 72 formed between the intermediate-pressure supply groove 67 and the high-pressure supply groove 69 independently of the high-pressure supply groove 69 enables the backpressure space 77 to be supplied with high pressure before the backpressure space 77 communicates with the high-pressure supply groove 69. Thus, by the time the backpressure space 77 communicates with the high-pressure supply groove 69, the backpressure space 77 is already at high pressure. Chattering is thereby prevented.

Figure 5:
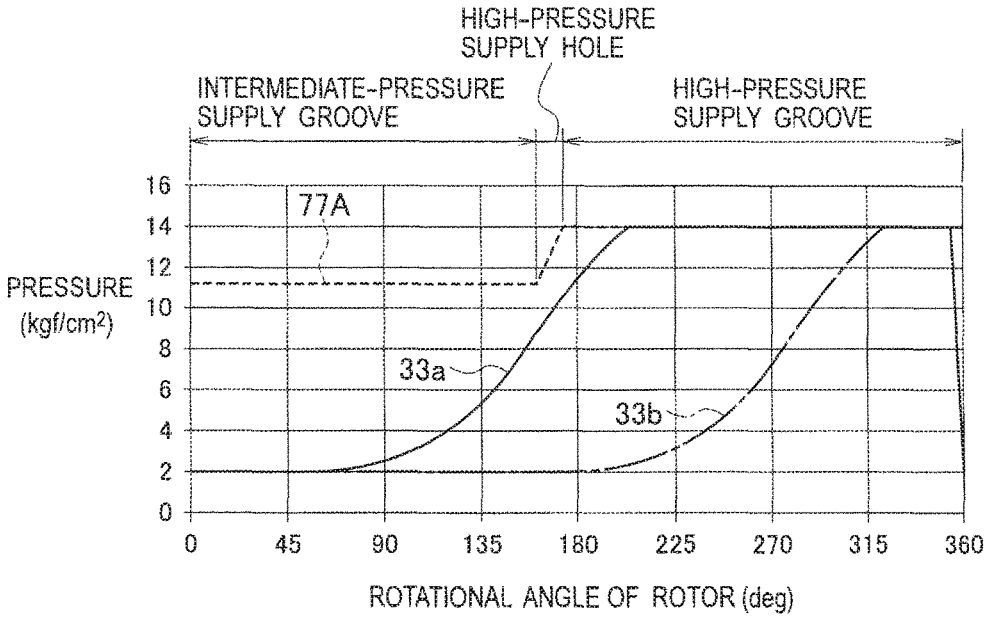
FIG. 5 is a graph showing a relation among a rotational angle of a rotor, pressure in a compression chamber, and pressure in a backpressure space, when the compression block according to the embodiment of the present invention is used.
Figure 6:
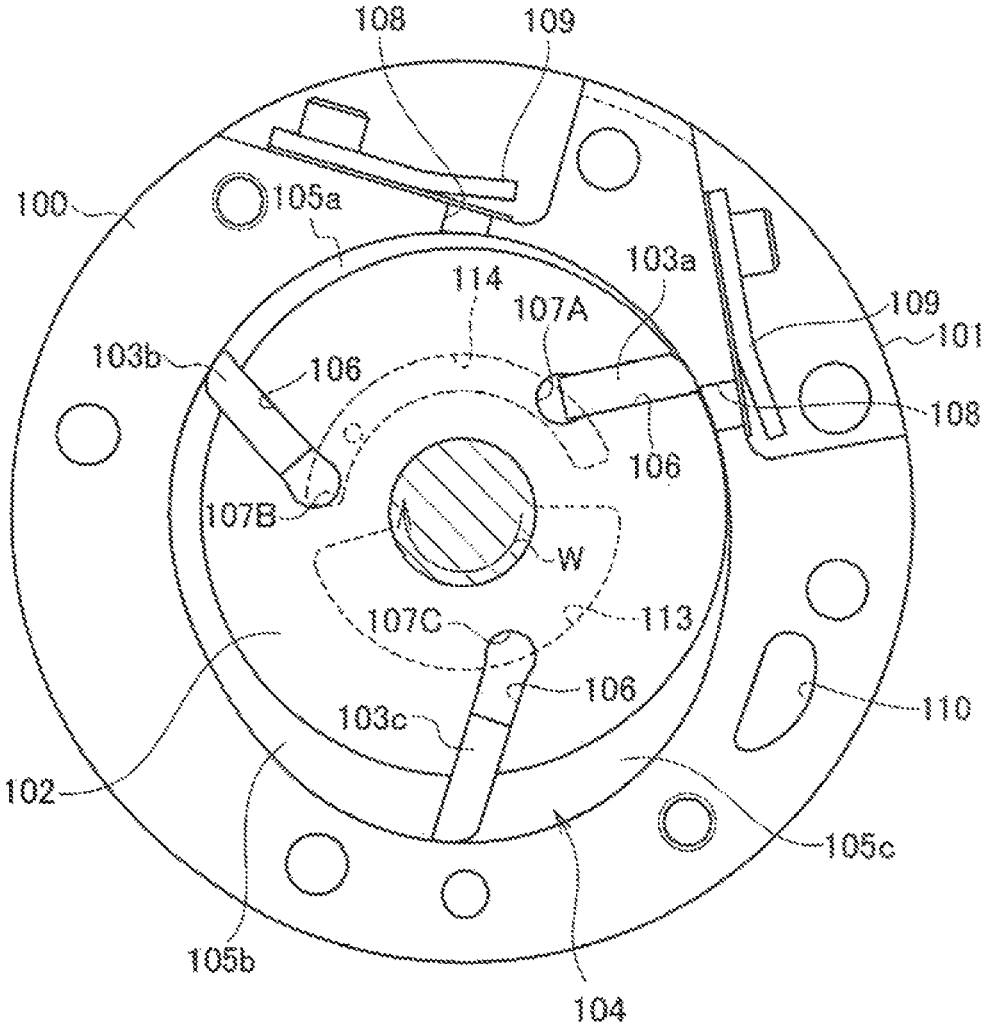
FIG. 6 shows a compression block used in a conventional gas compressor.
Figure 7:
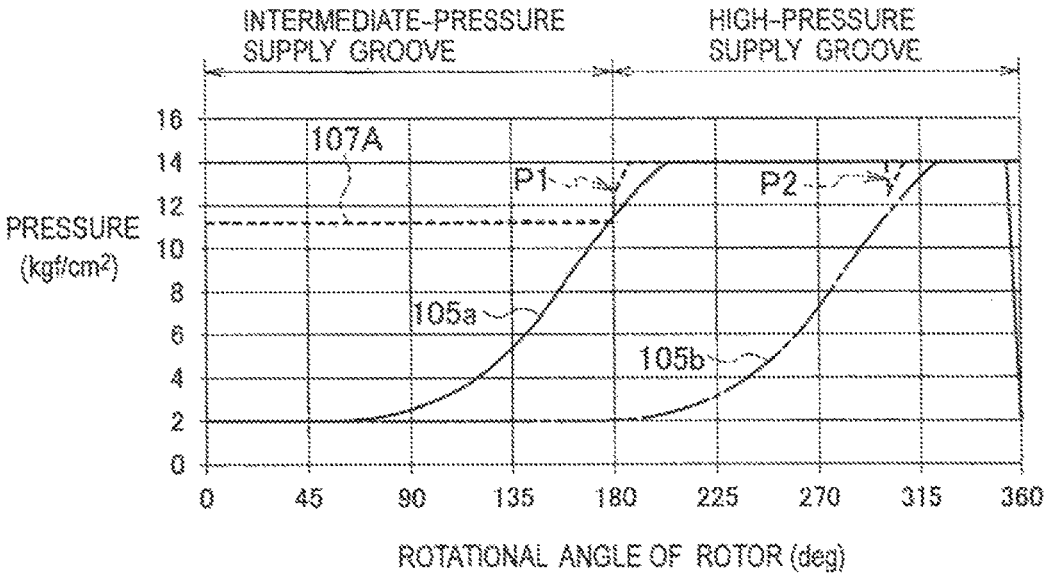
FIG. 7 is a graph showing a relation among a rotational angle of a rotor, pressure in a compression chamber, and pressure in a backpressure space, when the conventional compression block is used.

As shown in FIG. 5, when two backpressure spaces 77 adjacent in the circumferential direction of the rotor 23 communicate with the high-pressure supply groove 69 simultaneously, high pressure is supplied to the backpressure space 77B before the backpressure space 77B communicates with the high-pressure supply groove 69. Thus, pressure in the rotationally-upstream backpressure space 77A does not drop even after the rotationally-downstream backpressure space 77B communicates with the high-pressure supply groove 69. Chattering is thereby prevented.

The distance h1 between the intermediate-pressure supply groove 67 and the high-pressure supply hole 72 in the circumferential direction of the rotor 23 is larger (wider) than the width h2 of each backpressure space 77. Thus, the intermediate-pressure supply groove 67 and the high-pressure supply hole 72 do not communicate with each other through the backpressure space 77. This ensures that the backpressure space 77 is supplied with high pressure through the high-pressure supply hole 72.

The present application claims the priority from Japanese Patent Application No. 2014-002173 filed on Jan. 9, 2014, the entire content of which is incorporated herein by reference.

The present invention has been described using the embodiment. However, as it is obvious to those skilled in the art, the present invention is not limited to what has been described above and can be modified or improved variously.

INDUSTRIAL APPLICABILITY

According to the present invention, a second high-pressure supply part is formed between an intermediate-pressure supply part and a first high-pressure supply part, independently of the first high-pressure supply part. This enables a backpressure space to be supplied with high pressure before the backpressure space communicates with the first high-pressure supply part. Thus, high pressure can be maintained in the first high-pressure supply part to prevent pressure drop in the backpressure space behind a vane. The high pressure maintained in the first high-pressure supply part prevents the vane from being pushed back to its vane groove, and therefore prevents chattering.

REFERENCE SIGNS LIST

1 gas compressor
19 compression block (block part)
23 rotor
25 vane
32 cylinder chamber
33 compression chamber
51 intermediate-pressure supply groove (intermediate-pressure supply part)
53 high-pressure supply groove (first high-pressure supply part)
67 intermediate-pressure supply groove (intermediate-pressure supply part)
69 high-pressure supply groove (first high-pressure supply part)
72 high-pressure supply hole (second high-pressure supply part)
77 backpressure space

The invention claimed is:

1. A gas compressor comprising:
a block inside which a cylinder chamber is formed;
a rotor rotatably housed in the cylinder chamber; and
a plurality of vanes provided in an outer circumferential portion of the rotor at an interval in a circumferential direction of the rotor, the vanes being structured to emerge from the outer circumferential portion,
an inner circumferential surface of the cylinder chamber, an outer circumferential surface of the rotor, and each two of the vanes adjacent in the circumferential direction of the rotor defining a compression chamber inside the cylinder chamber,
the block having a pressure supply part configured to supply pressure to backpressure spaces formed behind the respective vanes, wherein
the pressure supply part has
an intermediate-pressure supply part which communicates with each backpressure space from an intake cycle to a compression cycle in the compression chamber,
a first high-pressure supply part which communicates with the backpressure space from the compression cycle to a discharge cycle in the compression chamber, and
a second high-pressure supply part which is formed between the intermediate-pressure supply part and the first high-pressure supply part independently of the first high-pressure supply part and which communicates with the backpressure space in a middle of the compression cycle in the compression chamber.

2. The gas compressor according to claim 1, wherein
the first high-pressure supply part is formed over an area where the first high-pressure supply part communicates simultaneously with two of the backpressure spaces adjacent in the circumferential direction of the rotor.

3. The gas compressor according to claim 2, wherein
the block comprises a tubular cylinder block and paired side blocks placed on both sides of the cylinder block, and
the intermediate-pressure supply part, the first high-pressure supply part, and the second high-pressure supply part are formed in an inner end surface of at least one of the paired side blocks.

4. The gas compressor according to claim 1, wherein
the block comprises a tubular cylinder block and paired side blocks placed on both sides of the cylinder block, and
the intermediate-pressure supply part, the first high-pressure supply part, and the second high-pressure supply part are formed in an inner end surface of at least one of the paired side blocks.

* * * * *